US005510584A

United States Patent [19]

Norris

[11] Patent Number: 5,510,584

[45] Date of Patent: Apr. 23, 1996

[54] SEQUENTIALLY OPERATED SNAP ACTION MEMBRANE SWITCHES

[75] Inventor: Jeffrey J. Norris, Bloomington, Minn.

[73] Assignee: ITT Corporation, New York, N.Y.

[21] Appl. No.: 400,049

[22] Filed: Mar. 7, 1995

[51] Int. Cl.[6] ..... H01H 13/70; H01H 1/02

[52] U.S. Cl. ..... 200/5 A; 200/1 B; 200/512; 200/345

[58] Field of Search ..... 200/1 B, 5 R, 200/5 A, 512–517, 341–345, 292

[56] References Cited

U.S. PATENT DOCUMENTS

| | | | |
|---|---|---|---|
| 3,917,917 | 11/1975 | Murata | 200/517 |
| 3,996,429 | 12/1976 | Chu et al. | 200/5 A |
| 4,366,355 | 12/1982 | Oelsch | 200/517 |
| 4,376,238 | 3/1983 | Martin | 200/1 B X |
| 4,659,881 | 4/1987 | Dowe | 200/5 R |
| 4,720,609 | 1/1988 | Hochgesang et al. | 200/5 A |
| 4,778,952 | 10/1988 | Watkins et al. | 200/5 A |
| 4,939,324 | 7/1990 | English et al. | 200/345 |
| 4,987,275 | 1/1991 | Miller et al. | 200/5 A |
| 5,199,557 | 6/1993 | Brandt et al. | 200/517 X |
| 5,268,542 | 12/1993 | Voll | 200/5 A |
| 5,290,983 | 3/1994 | Roberts | 200/292 X |
| 5,313,027 | 5/1994 | Inoue et al. | 200/5 A |
| 5,350,890 | 9/1994 | Fairbrother et al. | 200/5 A |

FOREIGN PATENT DOCUMENTS

| | | | |
|---|---|---|---|
| 2257299 | 6/1993 | United Kingdom | H01H 13/64 |

*Primary Examiner*—J. R. Scott

*Attorney, Agent, or Firm*—Freilich Hornbaker Rosen

[57] ABSTRACT

A switching apparatus which includes a rubber keypad (32, FIG. 2) with a rubber cap (36) that can be depressed by a person's finger to snap a snap dome (52) that connects contacts (21, 22) of a first switch (70), provides increased tactile feedback to the person's finger. A keycap (42) of rigid material includes a cover (44) lying on top of the rubber cap and also includes a stem (54) that projects down through a hole in the cap, with a lower stem end (60) lying above the snap dome to snap down the dome when a person's finger depresses the cover. The tactile snap feedback is transmitted directly through the rigid material of the stem to the rigid material of the cover, to the person's finger to indicate that the switch has been closed. The cap has a radially outer part (84), and an electrically conductive element (82) is mounted on the outer part to engage contacts (23, 24) of a second switch (80) to close it, before the snap dome is snapped to close the first switch. The coupling portion (38) is designed to not produce a tactile response, and the conductive element is preferably of conductive elastomeric material to avoid a tactile feedback that would falsely indicate that both switches were closed.

9 Claims, 1 Drawing Sheet

SEQUENTIALLY OPERATED SNAP ACTION MEMBRANE SWITCHES

BACKGROUND OF THE INVENTION

One type of switching apparatus useful for low current and low voltage applications includes a rubber or other elastomeric keypad with a mount in the form of a plate lying on a circuit board that contains first and second contacts of a first switch. A snap dome lies on the first contact and its middle lies over the second contact. The keypad includes an integral rubber cap that can be depressed to push down the middle of the snap dome and cause it to snap down and connect the contacts. When the dome snaps, it produces a tactile feedback that is transmitted through the rubber cap to the person's finger to indicate that the switch has been closed. However, some of the tactile feedback is absorbed by the rubber cap. It would be desirable if the tactile feedback could be more efficiently transmitted to the person's finger.

One application for the above type of switching apparatus, is for a circuit that requires two switches, with contacts of the second switch connected before the snap dome connects the contacts of the first switch. Such a dual switch is useful where the second switch actuates a wake-up circuit that must be actuated a short time before the first switch is closed. Such a switching apparatus is useful in cameras, where the wake-up circuit may activate a range finder while the first switch activates a shutter. It would be desirable if the second switch could be closed before the first switch, but with minimal tactile feedback on closing of the second contact, and yet with considerable tactile feedback upon closing of the first contact.

SUMMARY OF THE INVENTION

In accordance with one embodiment of the present invention, a switching apparatus is provided that efficiently transmits tactile feedback from a snap dome to a person's finger to indicate when a switch has been closed. The apparatus can also provide a second switch which is closed before the first one but which produces minimal tactile feedback so a person does not erroneously think that the switches have been closed when only the second switch is closed.

The switching apparatus includes an elastomeric keypad with an elastomeric cap having a middle lying above the snap dome which can snap to connect first and second contacts of the first switch. The keypad includes a coupling portion that mechanically couples the cap to a mount that lies on a circuit board containing the switch contacts, the parts being integral and formed of elastomeric material. A keycap of rigid material includes a cover lying on the elastomeric cap and a stem projecting down through a hole in the cover and having a lower stem end positioned above the snap dome. When a person's finger depresses the cover, the stem depresses and snaps the snap dome, with tactile feedback of the snap being transmitted through the rigid material of the stem and cover to the person's finger.

An electrically conductive element is mounted on a radially outer part of the elastomeric cap. When the rigid cover and elastomeric cap are depressed, the conductive element moves down to engage third and fourth contacts of a second switch to close it. The second switch is closed prior to the stem snapping the snap dome to close the first switch. The conductive element is preferably of elastomeric material so that when it engages the third and fourth contacts, very little tactile feedback is created, and most of any tactile feedback is absorbed by the elastomeric cap.

The novel features of the invention are set forth with particularity in the appended claims. The invention will be best understood from the following description when read in conjunction with the accompanying drawings.

DESCRIPTION OF THE PREFERRED EMBODIMENT

Figure 1:
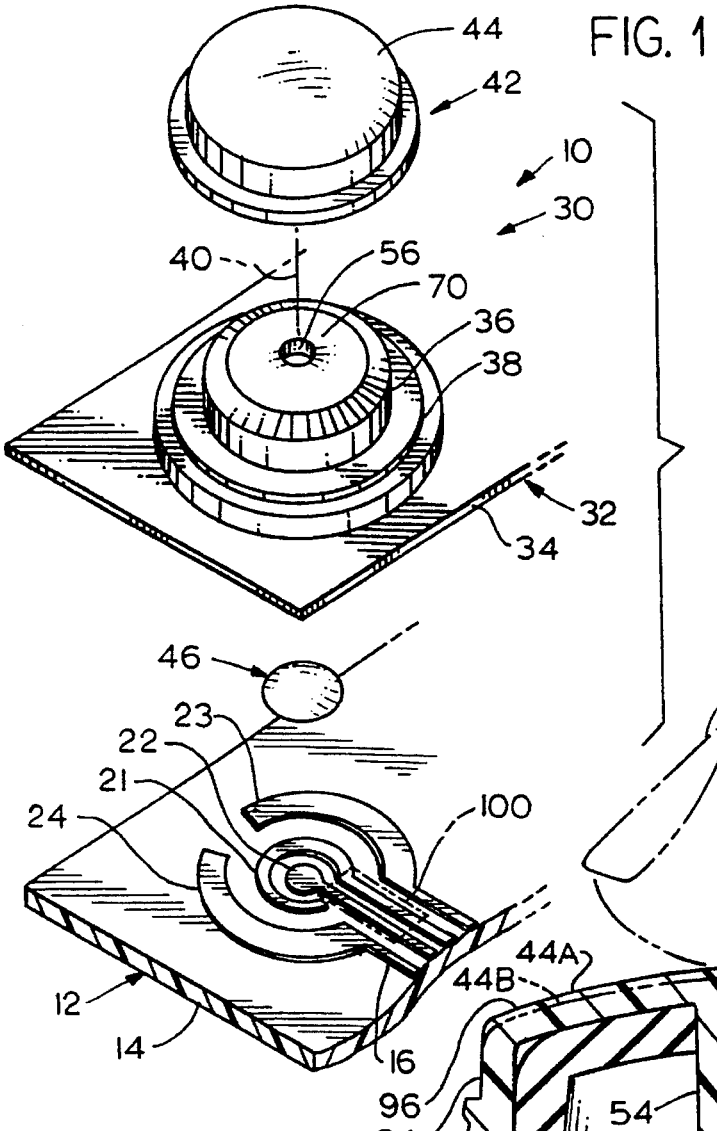
FIG. 1 is an exploded isometric view of a switching apparatus constructed in accordance with the present invention.

FIG. 1 illustrates a switch assembly 10 which includes a board device 12 comprising a board 14 and electrically conductive traces 16 on the board. The traces include a first pair of switch contacts comprising first and second contacts 21, 22, and a second pair of switch contacts comprising third and fourth contacts 23, 24. A keyboard actuator 30 includes a keypad 32 with a mount portion or mount 34 that is generally plate-like and which lies facewise substantially against the board device 12. The keypad also include a cap 36 which is depressed to connect the two pairs of contacts, and a coupling portion 38 which supports the cap 36 on the mount 34. The coupling portion is elastic, and permits the cap 36 to move vertically along an axis 40 while resiliently resisting such movement. All portions of the keypad 32 are formed of elastomeric material such as rubber. A keycap 42 formed of rigid material such as an engineering plastic, includes a cover 44 that can be depressed. A snap dome 46 is used to connect the first and second contacts 21, 22.

Figure 2:
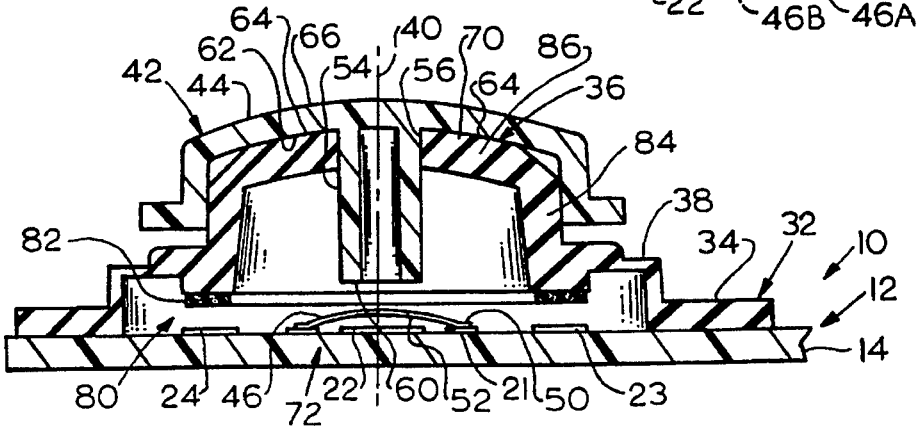
FIG. 2 is a sectional view of the assembled switch apparatus, in a fully open position.

As shown in FIG. 2, the snap dome 46 has a vertical axis coincident with the axis 40. A radially outer portion 50 of the snap dome lies on the first contact 21 to continually engage it. A radially inner portion 52 of the snap dome lies over the second contact 22 and must be depressed to engage the second contact. The keycap 42 includes a stem 54 that projects downwardly through a hole 56 at the middle of the elastomeric cap 36. The stem has a lower stem end 60 that lies above the middle or radially inner portion 52 of the snap dome.

The cover 44 has a lower surface 62 that lies facewise against an upper surface 64 of the elastomeric cap 36, at an area around the hole 56 in the cap. When a person presses his finger downwardly against the upper surface 66 of the cover, the cover moves down and moves down the middle 70 of the elastomeric cap 36. The coupling portion 38 resiliently resists such downward movement. When the cover has moved down far enough for the lower stem end 60 to engage the snap dome inner portion 52 and moved it down sufficiently, the dome snaps. When the dome snaps, its inner portion suddenly moves down against the second contact 22 and closes a first switch 72 that includes the first and second contacts.

As the stem moves down and snaps the dome, the dome creates a click which includes a sudden change in resistance to depression of the stem, as well as a pulse, both of which form a tactile feedback that is transmitted through the stem 54 and the cover 44 to the person's finger. This allows the person to sense that the switch has been closed.

As mentioned above, the cap 36 is formed of elastomeric material and is integral with the mount 34 that mounts on the circuit board, all of which enables low cost construction. If the tactile feedback had to be transmitted through the elastomeric material of the cap 36, then some of the feedback would be absorbed by the elastomeric material. This could occur if a portion of the cap 36 directly engaged and depressed the snap dome, even if the rigid cover 44 were in place. By applicant transmitting tactile feedback only through the rigid material of the keycap 42, applicant avoids considerable absorption of the tactile feedback. However, the elastomeric material of the cap 36, coupling portion 38, and dome 34 all provide a low cost way to position the cover 44 above the snap dome and allow it to move vertically thereat.

Elastomeric material is characterized by large elastic deformation when small forces are applied. Most elastomers have a Young's modulus of elasticity of about 0.1 GPa or less. A rigid material is characterized by resistance to deformation when forces are applied. A rigid material may be defined as one having a Young's modulus of elasticity of at least about 0.35 GPa. Most engineering plastics such as acrylics, Vinyls (unplasticized) and nylons have a Young's modulus of about 2 to 4 GPa and will efficiently transmit the tactile feedback of a snap dome.

In some applications, two switches are required, which must be closed at substantially the same time or with a second switch required to be closed slightly before the first switch is closed. One application is in cameras where a second switch must be closed to activate a range finder a fraction of a second before a first switch is closed to operate a shutter. Applicant's third and fourth contacts 22, 24 are part of a second switch 80 of the switch apparatus 10. The second switch also includes an electrically conductive element 82 that is mounted at the lower end of a primarily vertical column-like (appears as a column in the sectional view) outer part 84 of the cap 36. When the cover 44 is depressed so a top layer of plate 86 of the cap (which includes the middle 70) is depressed, the radially outer part 84 also moves down. As the cap moves down, the conductive element 82 moves down until it engages the third and fourth contacts 23, 24 to connect them together and close the second switch.

Figure 3:
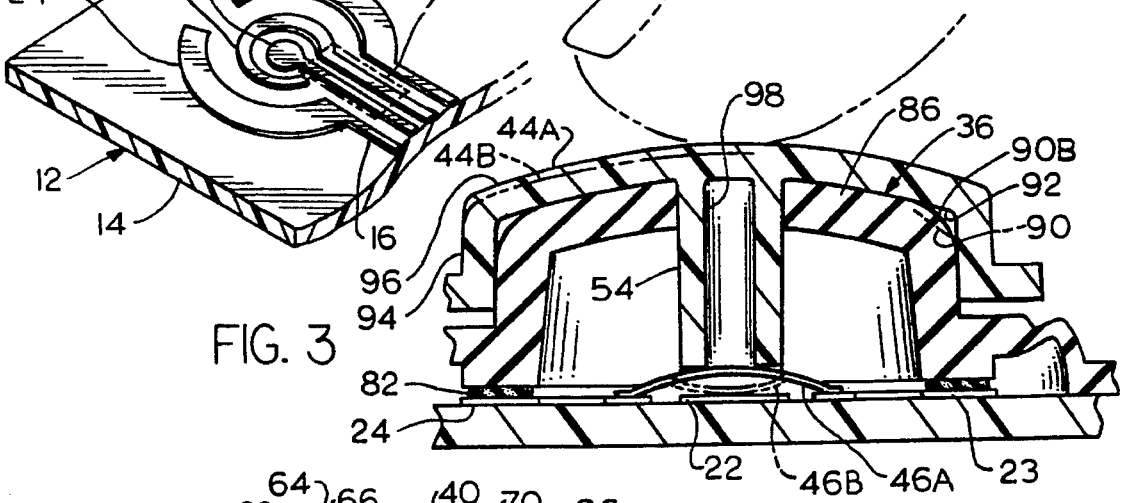
FIG. 3 shows the switch apparatus of FIG. 2 partially depressed by a finger, and showing, in phantom lines, the dome in its fully depressed position.

For the particular switch assembly 10, the second switch 80 that includes the third and fourth contacts 23, 24 must be closed before the first switch 70 which includes the first and second contacts 21, 22. FIG. 3 shows that the conductive element 82 is positioned so it engages the third and fourth elements 23, 24 before the snap dome at 46A is fully snapped to the position 46B. Only after slightly further downward movement of the cover at 44A by the finger F of a person, beyond the position shown in FIG. 3, does the stem 54 depress the snap dome far enough for its middle to snap down to the dome position 46B and engage the second contact 22. When the finger pushes down on the cover 44, the conductive element 82 first engages its pair of contacts with a light force a fraction of a second before the snap dome snaps and connects its contacts with a heavy force. The person does not sense closing of the second switch as the conductive element 82 engages the third and fourth contacts. One reason is that any tactile feedback created by the element 82 suddenly hitting the third and fourth contacts, is largely absorbed by the elastomeric material of the outer part 84 and top plate 86 of the elastomeric cap, before the feedback is transmitted to the cover 44. In addition, applicant prefers to construct the conductive element 82 of electrically conductive elastomeric material, so that when the element 82 strikes the third and fourth contacts, a minimal click is created. Furthermore, the coupling portion 38 is designed to avoid the creation of a tactile response.

After the cover reaches the position 44A shown in FIG. 3, it must be moved down a further amount to the position 44B to snap the snap dome. Most of the downward movement is absorbed by elastic compression of the top plate 86, resulting in deflection of a peripheral part at 90B, which is shown deflected from its original configuration at 90. The peripheral part deforms into a space 92 at the inside corner of the cover 44, where a cylindrical depending portion 94 of the cover merges with a top portion 96 of the cover.

The elastomeric keypad 32 is molded with one or more caps and coupling portions, only one being shown in the figures. The elastomeric conductive element 82 is cut from a sheet of such conductive material, and attached to the cap outer part by adhesive. Electrically conductive elastomeric material can be made by mixing powder of conductive material such as silver in the elastomeric material when it is liquid. The keycap 42 is molded of rigid plastic material. The hole 98 in the stem is provided to avoid a molded portion of large thickness, which can result in a dimple at the middle of the upper surface of the cover. The keycap can be held in place to the cap by slight elastic compression of the cap 36 and/or by bonding. As shown in FIG. 1, a thin insulative sheet 100 is placed over portions of the traces to avoid shorting by the snap dome 46 or conductive element 82.

Although terms such as "vertical" and "down" have been used to help describe the apparatus as illustrated, the apparatus can be used in any orientation with respect to Earth's gravity.

Thus, the invention provides a switch assembly that uses a molded elastomeric keypad for low cost construction, while providing efficient tactile feedback of a snapping snap dome. This is accomplished by providing a rigid keycap with a cover that is engaged by a person's finger, and with a stem or other portion extends down through a cap of the keypad and which directly engages the snap dome to depress and snap it. Where a second switch is required, which must be closed before closing of the first switch, a conductive element is attached to the cap to engage third and fourth elements before a stem or other part of the cover snaps the snap dome, with the conductive element preferably being of elastomeric material. As a result, any tactile feedback created when the conductive element engages the third and fourth contacts, is minimal and is largely absorbed by the elastomeric material of the cap.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An elastomeric cap-dome type switch assembly comprising:

a board device which includes a board and first and second electrical contacts mounted on said board;

an electrically conductive dome which has a vertical axis, a radially outer portion that engages said first contact, and a radially inner portion that lies over said second contact;

a keypad which includes an elastomeric cap having an axis and having a hole and being spaced above said snap dome, said elastomeric cap having an outer part, said keypad including a mount mounted on said board device and a deflectable coupling portion that supports said elastomeric cap outer part in vertical movement on said mount;

a keycap of rigid material which includes a cover lying on top of said elastomeric cap and having a stem that projects downwardly through said hole with said stem having a lower end that lies above said snap dome to snap down said dome when said keycap moves down, whereby tactile feedback of snapping of said dome is transmitted through said stem directly to said cover.

2. The assembly described in claim 1 including:

third and fourth contacts mounted on said board;

an electrically conductive element mounted on said outer part of said elastomeric cap at a position to engage said third and fourth contacts when said elastomeric cap is deflected down by a downward force on said cover portion.

3. The assembly described in claim 2 wherein:

said conductive element is positioned low enough that it engages said third and fourth contacts prior to said stem end snapping down said snap dome.

4. The assembly described in claim 2 wherein:

said conductive element is formed of conductive elastomeric material, to avoid a tactile feedback before said snap dome snaps.

5. The assembly described in claim 1 including:

third and fourth contacts mounted on said board;

said elastomeric cap includes a primarily horizontally-extending top plate having a peripheral part and said outer part comprises a primarily vertically-extending column-like support depending from said peripheral part and having a lower end;

an annular electrically conductive element mounted on said lower end of said column-like support, with said third and fourth contacts being positioned to be both engaged by said conductive element when said column-like support moves down;

said cover of said keycap and said top plate of said elastomeric cap portion are formed so they engage each other immediately around said hole but not at said peripheral portion of said top plate, so at least said peripheral portion of said top plate is deformed when said key cap continues to be pressed down after said column support resists further downward movement when said conductive element engages said third and fourth contacts.

6. The assembly described in claim 1 wherein:

said cap, mount, and coupling portion are integrally formed of elastomeric material, with said coupling portion being elastically deflectable, so that portion of cover downward deflection which is not resisted by dome resistance to deflection, is resisted by elastic deflection of elastomeric material of said keypad.

7. An elastomeric keypad dome type switch assembly comprising:

a board device which includes a board, and first and second pairs of contacts mounted on said board;

an electrically conductive snap dome which has a vertical axis, a radially outer portion that engages one of the contacts of said first pair and a radially inner portion that lies over the other of said contacts of said first pair;

a keyboard actuator which includes a keypad formed of elastomeric material and which includes an elastomeric cap having a vertical axis and having a middle lying over said first pair of contacts and a radially outer part, said keypad including an elastomeric mount mounted on said board device and an elastomeric coupling portion supporting said outer part of said cap in vertical movement on said mount;

said keyboard actuator including a depending portion coupled to said middle of said cap and lying over said snap dome so as said cap middle moves down said depending portion depresses said snap dome inner portion to cause it to snap and engage said first pair of contacts;

an electrically conductive element mounted on said radially outer part of said cap over said second pair of contacts so when said cap is pressed downwardly said conductive element engages said second pair of contacts, said conductive element being positioned to engage said second pair of contacts before said depending portion snaps said snap dome.

8. The assembly described in claim 7 wherein:

said middle of said elastomeric cap has a vertical hole;

said keyboard actuator includes a keycap of rigid material, said keycap including a cover that lies on said middle of said elastomeric cap and also including a stem that forms said depending portion and that projects down through said hole and that has a stem lower end lying above said snap dome to depress it.

9. A method for operating a switch that includes a keypad of elastomeric material having a cap lying over two pairs of contacts on a board, with a snap dome lying over a first of the pairs of contacts, with a conductive element lying at the bottom of a radially outer portion of the cap over a second of the pairs of contacts, and with a keycap of rigid material lying on said cap, comprising:

forming said keycap with a cover lying on said cap and with a stem projecting down through said cap and lying over said snap dome;

applying a person's finger to said cover to depress it and said cap until said conductive element engages said second pair of contacts, and then depressing said cover further until said stem depresses and snaps said snap dome to cause said snap dome to engage both contacts of said first pair, and transmitting snap indicating forces through said stem and said cover to the person's finger.

* * * * *